United States Patent [19]

Pesek

[11] Patent Number: 4,920,892

[45] Date of Patent: May 1, 1990

[54] PORTABLE ROPE TOW

[76] Inventor: Roman Pesek, 3 - 119E 6th Street R.P., North Vancouver, British Columbia, Canada, V7L 1N9

[21] Appl. No.: 268,309

[22] Filed: Nov. 7, 1988

[51] Int. Cl.[5] ..... B61B 12/02

[52] U.S. Cl. ..... 104/173.2; 104/178

[58] Field of Search ..... 104/173.2, 178; 474/133

[56] References Cited

U.S. PATENT DOCUMENTS

| | | | |
|---|---|---|---|
| 2,646,005 | 7/1953 | Swanson | 104/173.2 |
| 3,221,667 | 12/1965 | Watt | 104/173.2 |
| 3,368,498 | 2/1968 | Doveri | 104/173.2 |
| 4,023,502 | 5/1977 | Elsing | 104/173.2 |
| 4,557,710 | 12/1985 | Greider | 474/133 X |
| 4,754,825 | 7/1988 | Sheffer | 104/173.2 X |

FOREIGN PATENT DOCUMENTS

| | | | |
|---|---|---|---|
| 198409 | 10/1986 | European Pat. Off. | 104/173.2 |
| 2064455 | 6/1981 | United Kingdom | 104/173.2 |

*Primary Examiner*—Andres Kashnikow
*Assistant Examiner*—Kevin P. Weldon
*Attorney, Agent, or Firm*—Townsend and Townsend

[57] ABSTRACT

A drive unit for a ski tow rope. The unit has a main frame with an engine having an output shaft mounted in the main frame. A drive pulley is driven by the output shaft and has a circumferential channel to receive the rope. Guide pulleys direct the rope into the main frame, around the drive pulley and out of the frame. The guide pulleys are made up of a pulley at the leading edge of the frame to receive the rope, a pulley at the trailing edge of the frame and a pair of holding pulleys adjacent the drive pulley and positioned to ensure that the rope contacts the maximum possible amount of the circumference of the drive pulley. The holding pulleys are able to pivot.

13 Claims, 2 Drawing Sheets

Fig. 2.
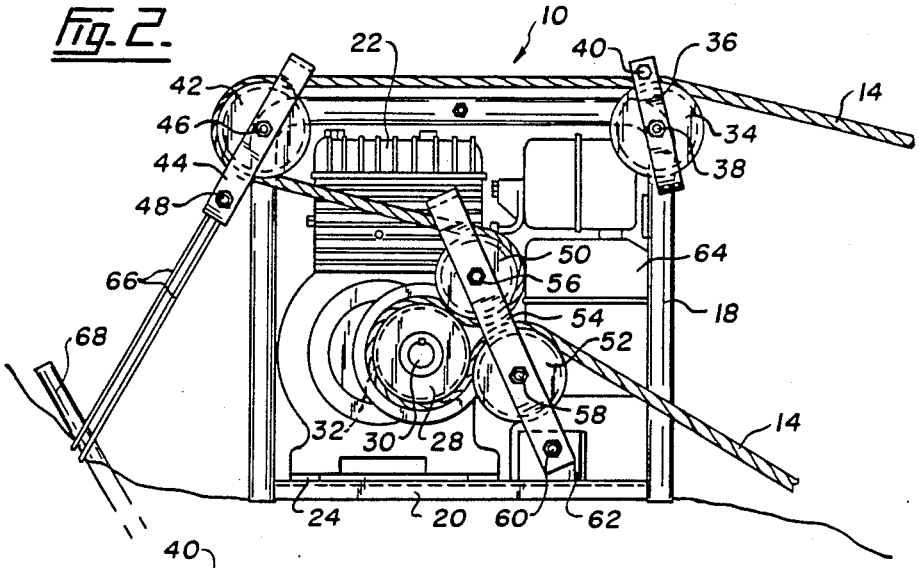
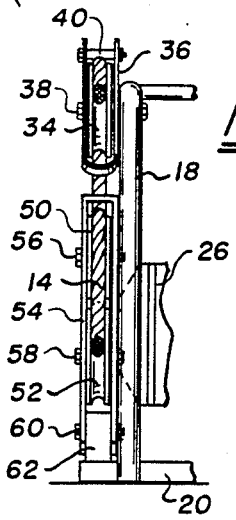
Fig. 3.
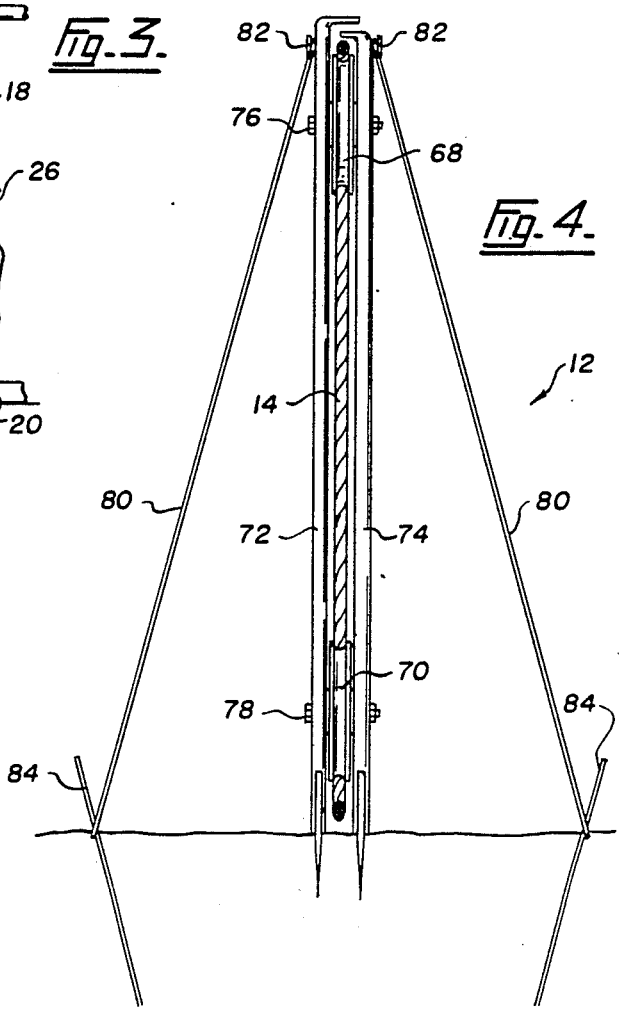
Fig. 4.

PORTABLE ROPE TOW

FIELD OF THE INVENTION

This invention relates to a drive unit for a ski tow rope and to a portable ski tow system.

Ski resorts go to great expense to install complex permanent lifts by which skiers are transported to the top of the mountain. Ski resorts also use temporary lifts of various sorts, typically T-bars which can be erected on, for example, glaciers by installing top and bottom mounts and having the intermediate mounts, which carry the rope from which the T-bars are suspended, in a floating manner on the glacier. This sort of lift is quite popular with summer ski camps, typically carried out at high altitude.

All the above installations, even the temporary lifts, are extremely expensive. They also obviously have considerable bulk. At the moment the only way in which a skier can go up a slope without the assistance of expensive, professionally installed lifts, is by a snowmobile or by climbing. A snowmobile is not entirely appropriate. Their use is usually frowned upon in ski resorts except for use by employees of the resorts. Climbing is a time consuming process that is physically demanding.

Accordingly, there is a need for an easily portable lift to be used by small groups on all sorts of ski terrain. Such lifts can be used on existing lift serviced terrain, for example, to set up a rope tow to be used by racers. By this means the racers do not have to use the publicly available tows, which can involve considerable waiting. Furthermore, a portable tow can open terrain that is inaccessible to large groups of skiers, can be used on glacier terrain or in summer skiing where there is no great public demand for the installation of expensive lifts but where relatively cheap, easy to install lifts, able to carry relatively small groups of skiers, would be appropriate.

Applicant is not aware of any solution to these problems prior to the present invention.

The present invention seeks to provide a lightweight, portable ski tow whose components can be carried by individuals, can be carried on or easily towed behind a snowmobile.

Accordingly, in a first aspect the present invention is a drive unit for a ski tow rope comprising:

a main frame;

an engine having an output shaft mounted in the main frame;

a drive pulley driven by the output shaft and having a circumferential channel to receive the rope;

a plurality of guide pulleys to direct the rope into the main frame, around the drive pulley and out of the frame, the guide pulleys comprising:

a first guide pulley at the leading edge of the frame to receive the rope;

a second pulley at the trailing edge of the frame;

a pair of holding pulleys adjacent the drive pulley and positioned to ensure that the rope contacts the maximum possible amount of the circumference of the drive pulley.

In a preferred embodiment the engine is an internal combustion engine and the frame includes a fuel tank for the engine.

In a further aspect the present invention is a portable ski tow system comprising a drive unit as defined above in combination with a rope return station, to be located at the base of the ski slope and comprising a pair of idler pulleys, an upper idler pulley to receive rope moving in the direction of the drive unit and a lower pulley to receive tow rope moving in the direction of the rope return station; and means anchoring the rope return unit at the base of the ski slope.

Aspects of the invention are illustrated, merely by way of example, in the accompanying drawings in which:

FIG. 2 is a side elevation of the drive unit to the ski lift of FIG. 1;

FIG. 3 is a partial end view of the drive unit of FIG. 2; and

FIG. 4 is an end elevation of the rope return station shown in FIG. 1.

Figure 1:
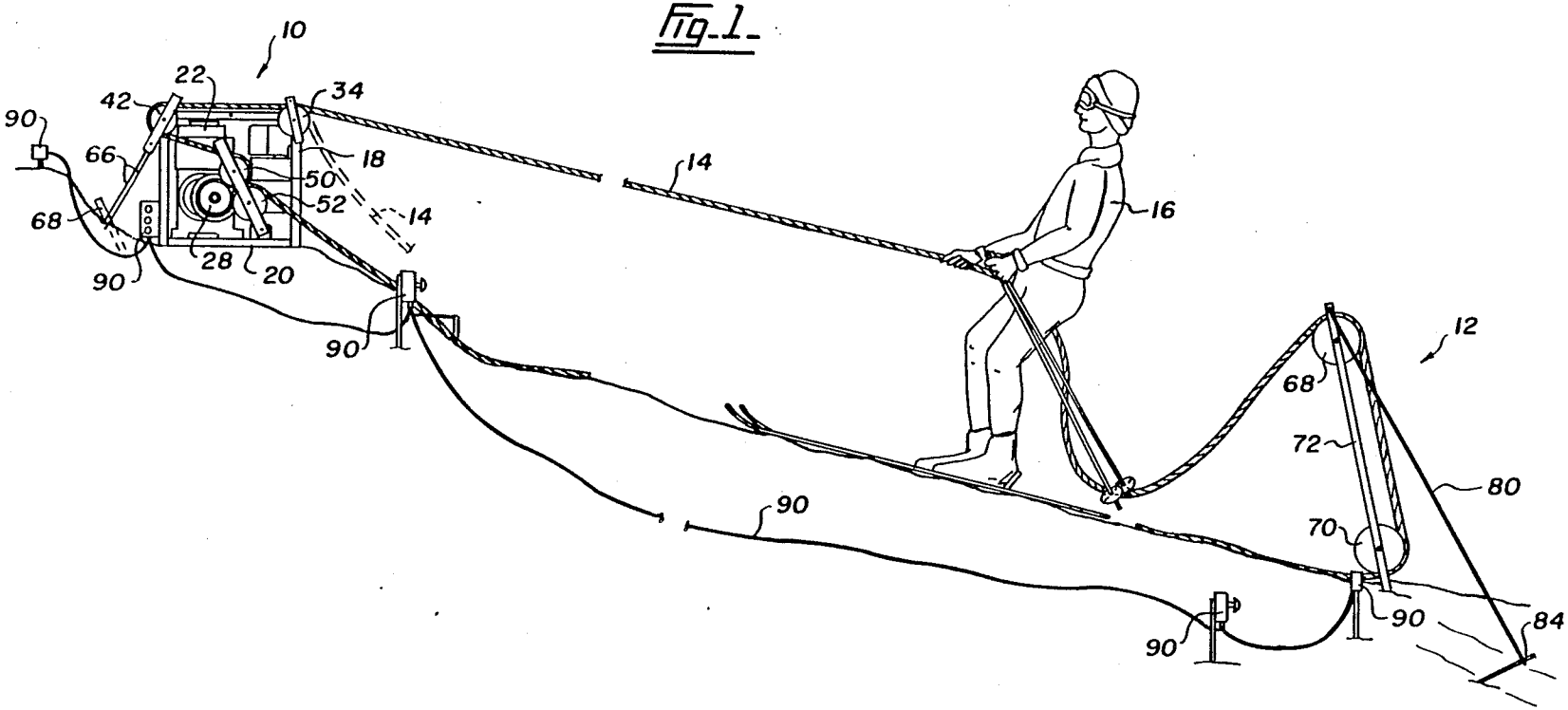
FIG. 1 is a view of a ski lift according to the present invention.

The drawings show a ski lift comprising a drive unit 10 at an upper station, a rope return station 12, to be located at the bottom of the hill, and a tow rope 14 extending between the two stations, driven by the drive unit 10 and, of course, to be held by a skier 16, shown in FIG. 1, while the skier is towed up the hill.

The drive unit comprises a main frame typically of tubular U-members 18 with cross braces 20, as shown partially in FIG. 3. There is an engine 22, for example an air cooled five horsepower engine having an output shaft (not shown) and mounted in the main frame at 24. The output shaft drives a conventional gear reducer 26. A drive pulley 28 is mounted on output shaft 30 of the gear reducer 26. The drive pulley 28 has a peripheral channel 32 to receive the rope 14.

There are a plurality of guide pulleys to direct the rope into the main frame, around the drive pulley 28 and out of the frame. A first guide pulley is mounted at the leading edge of the frame to receive the rope 14. The first guide pulley 34 is located in a bracket 36 that is of a general U-shape configuration and pivotally mounted to the frame by a bolt 38 which is also the axle for pulley 34. The bracket is closed at the top by a bolt 40, acting to maintain the rope 14 in contact with the pulley 34.

There is a second pulley 42 at the trailing edge of the frame, again mounted within a generally U-shaped frame 44 pivotally mounted by a bolt 46 which also acts as the axle for the second pulley 42. Again the frame 44 is closed by a bolt 48.

There are first and second holding pulleys 50 and 52, respectively, adjacent the drive pulley 28. These pulleys 50 and 52, which are positioned in a support member comprising a U-bracket 54, ensure that the rope 14 contacts the maximum possible amount of the circumference of the drive pulley 28. To this end they are mounted close together in a bracket 54 to ensure that the rope 14 follows the configuration shown most clearly in FIG. 2. The holding pulleys 50 and 52 are each pivotally mounted on a bolt 56 and 58 extending through the bracket 54. The bracket 54 is pivotally mounted by a bolt 60 extending through a mounting member 62 attached to the frame.

As shown particularly in FIG. 2 the engine 22 is an air cooled internal combustion engine. A fuel tank 64 is provided for the engine.

There is a system to anchor the frame onto the ski slope, as shown in FIGS. 1 and 2.

As shown most clearly in FIG. 2 the anchor is connected to the mounting bracket 44 for the second guide pulley 42. The closing bolt 48 is engaged by a rope 66 which extends around a stave 68 driven deep into the snow and, if possible, into the ground beneath the snow. The stave 68 leans to facilitate retention of the rope 66.

The rope return station 12, located at the bottom of the slope as shown in FIG. 1, is detailed in FIG. 4. The rope return station consists of a pair of idler pulleys 68 and 70, mounted in a frame. The upper idler pulley 68 receives the rope 14 moving in the direction of the drive unit 10, that is up the hill, and the lower pulley 70 receives the rope 14 moving in the direction of the rope return station 12. The frame made up of spaced members 72 and 74 is anchored to the bottom of the ski slope by being driven into the snow. The pulleys 68 and 70 rotate on bolts 76 and 78 which anchor the members 72 and 74 together. Bracing ropes 80 extend from connections 82 at the top of the frame 72 and 74 downhill from the station 12 to staves 84 driven in the snow. The staves 84 should be driven as deep as possible into the snow.

At the top the frame members 72 and 74 are bent at right angles towards each other to keep the rope 14 within the upper pulley 68.

The device is simple to operate. The drive unit according to the present invention can weigh as little as 18 kg and can be carried or hauled easily by one person. The rope's weight will vary depending upon the length of the rope but relatively light ropes, for example of propylene or nylon, are now available. The weight of the rope return station is clearly not great.

The ski tow is set up as follows. When an appropriate slope is selected the drive unit 10 is carried to the top of the slope. The anchor stave 68 is driven into the slope, as deep as possible,. and the ropes 66 from the second guide pulley frame 44 are attached to the stave 68.

The rope 14 is preferably an endless rope that is always located on the drive unit.

The rope 14 is unraveled down the slope and the rope return station 12 is then assembled by placing the rope over the pulleys 68 and 70 and bolting the pulleys between the frame members 72 and 74, which are then driven into the snow. The bracing ropes 80 are attached to the staves 84.

Starting of the engine 22 then produces a tow able to haul skiers up a slope.

An important feature of the present invention is that there is no tension on the tow rope 14 behind the skier as he is towed up a hill. This design makes possible very easy handling and in particular, makes the tow suitable for children and beginners. The output shaft of the engine 22 drives the gear reducer 24 upon which the drive pulley 14 is mounted so that the speed of the pulley 14 is reduced compared to crank shaft revolution speed of the engine. The speed of the engine 22 can also be controlled so that it operates at relatively low revolutions and cannot go above that speed.

The most important feature of the system is that the friction between the rope 14 and the drive pulley 28 increases with the load, which thus eliminates slippage on the pulley 28. The contact surface between the rope and drive pulley is increased by holding pulleys 50 and 52 ensuring sufficient friction between rope and pulley to move the rope without a skier or counterweight tension device.

It has been found that the maximum length of lightweight synthetic rope used to create the continuous loop is about 1,200 feet, giving a useful length of the tow rope of about 585 feet.

The present invention may be equipped with safety devices, whose parts are shown at 90, as is now standard in modern ski lifts. Such a device is necessary so that if a skier falls off the safety system can be easily operated to stop the motor and thus the tow. This can be done either by an observer, for example an attendant for the tow, or by the skier hitting a safety bar. Typically the safety will be interfaced with the ignition circuit of the engine. The ignition circuit can be grounded in the event of any problem, thus stopping the engine. The safety circuit operates on a 12 volt system. The system can be charged by an alternator driven by the engine.

An internal combustion engine is shown but an electric motor may just as easily be used provided a power source is available.

I claim:

1. A drive unit for a ski tow rope comprising:

a main frame;

an engine having an output shaft mounted in the main frame;

a drive pulley driven by the output shaft and having a circumferential channel to receive and frictionally engage an untensioned endless tow rope;

a plurality of pulleys to direct the rope into the main frame, around the drive pulley and out of the frame, the pulleys comprising:

a first guide pulley at the leading edge of the frame to receive the rope;

a second guide pulley at the trailing edge of the frame;

a support member pivotally mounted to said main frame;

first and second holding pulleys rotatably mounted in said support member adjacent the drive pulley, said first holding pulley being positioned generally above said drive pulley, and said second holding pulley being positioned generally beside said drive pulley and below said first holding pulley with said endless tow rope being trained over and around said first holding pulley, over and around said drive roller, and then over said second holding pulley such that said first and second holding pulleys act to ensure that the rope contacts the maximum possible amount of the circumference of said drive pulley.

2. A drive unit as claimed in claim 1 in which the drive is a gear reducer and the drive pulley is mounted on an output shaft of the gear reducer.

3. A drive unit as claimed in claim 1 including a system to anchor the frame on a ski slope.

4. A drive unit as claimed in claim 3 in which the anchor is connected to an extension of a bracket combining the second guide pulley.

5. A drive unit as claimed in claim 1 in which the support member for the pair of holding pulleys comprises carrier members spaced to receive the two pulleys;

a bracket to which the carrier members are pivotally attached.

6. A drive unit as claimed in claim 1 in combination with an anchor to be placed into a ski slope.

7. A drive unit as claimed in claim 1 in combination with a rope return station to be located at the base of the ski slope.

8. A drive unit as claimed in claim 7 in which the rope return station comprises a pair of idler pulleys, an upper idler pulley to receive the rope moving in the direction of the drive unit and a lower pulley to receive the rope moving in the direction of the rope return station.

9. A drive unit as claimed in claim 8 in which a pair of spaced members are anchored into a ski slope, the idler pulleys being mounted between the spaced members.

10. A drive unit as claimed in claim 8 including bracing ropes extending from the top of the spaced members away from a tow rope received on the drive unit to an anchor.

11. A drive unit as claimed in claim 1 including a safety trip system.

12. A lightweight ski tow system comprising a drive unit to be located at the top of a ski slope to receive an untensioned endless tow rope and comprising:

a main frame;

an engine having an output shaft mounted in the main frame;

a drive pulley driven by the output shaft and having a circumferential channel to receive and frictionally engage the untensioned endless tow rope;

a plurality of pulleys to direct the rope into the main frame, around the drive pulley and out of the frame, the pulleys comprising:

a first guide pulley at the leading edge of the frame to receive the rope;

a second guide pulley at the trailing edge of the frame;

a support member pivotally mounted to said main frame;

first and second holding pulleys rotatably mounted in said support member adjacent the drive pulley, said first holding pulley being positioned generally above said drive pulley, and said second holding pulley being positioned generally beside said drive pulley and below said first holding pulley with said endless tow rope being trained over and around said first holding pulley, over and around said drive roller, and then over said second holding pulley such that said first and second holding pulleys act to ensure that the rope contacts the maximum possible amount of the circumference of said drive pulley a rope return station to be located at the base of the ski slope and comprising a pair of idler pulleys, an upper idler pulley to receive the rope moving in the direction of the drive unit and a lower pulley to receive the tow rope moving in the direction of the rope return station; and means anchoring the rope return unit adjacent the base of the ski slope.

13. A lightweight ski tow system as claimed in claim 12 including a safety trip system.

* * * * *